US005160201A

United States Patent [19]

Wrobel

[11] Patent Number: 5,160,201

[45] Date of Patent: Nov. 3, 1992

[54] ROTATABLE LED CLUSTER DEVICE

[75] Inventor: Avi Wrobel, Santa Monica, Calif.

[73] Assignee: Display Products, Incorporated, El Segundo, Calif.

[21] Appl. No.: 733,333

[22] Filed: Jul. 22, 1991

[51] Int. Cl.[5] ..... F21V 21/00

[52] U.S. Cl. ..... 362/249; 362/457; 362/800

[58] Field of Search ..... 362/249, 250, 252, 800, 362/226, 287, 288, 429, 457

[56] References Cited

U.S. PATENT DOCUMENTS

| | | | |
|---|---|---|---|
| 1,977,126 | 10/1934 | Graf | 362/252 |
| 3,120,350 | 2/1964 | Muenz | 362/32 |
| 4,161,021 | 7/1979 | George, Jr. | 362/806 |
| 4,211,955 | 7/1980 | Ray | 362/800 |
| 4,298,869 | 11/1981 | Okuno | 362/800 |
| 4,473,869 | 9/1984 | Widt | 362/226 |
| 4,630,183 | 12/1986 | Fujita | 362/800 |
| 4,965,457 | 10/1990 | Wrobel et al. | 362/457 |

*Primary Examiner*—James C. Yeung
*Attorney, Agent, or Firm*—Denton L. Anderson

[57] ABSTRACT

A panel illuminating module consisting of an array of light-emitting diodes is provided wherein the light from the array can be adjustably directed to a target after the module is installed within the panel. The module has two parts, an upper part carrying the light-emitting diodes, and a lower part which is designed to install into standard panel circuitry connectors. The upper part is attached to the lower part by a cylindrical shaft about which one of the two parts is rotatable. Spring tension normally holds the two parts together on the shaft and a locking pin normally prevents the two parts from rotating relative to one another. However, the two parts can be optionally pulled apart from one another (against the spring tension) to disengage the locking pin and to allow the two parts to rotate relative to one another.

5 Claims, 4 Drawing Sheets

ROTATABLE LED CLUSTER DEVICE

BACKGROUND

This invention relates generally to removable devices useful in illuminating panels, and specifically to devices which are removable and reinstallable via bayonet and/or other socket-style mounts.

Panels such as automobile dashboard panels are commonly illuminated by small, incandescent light bulbs. Such bulbs can be installed into the dashboard circuitry by a threaded male assembly (as used in conventional light bulbs), but for speed and ease of installing and de-installing, the bulbs may be connected to the dashboard circuitry via a bayonet connection.

Light bulbs, unfortunately, have a relatively short life span. Because of vibration and environmental stresses inherent in the use in automobile dashboards, light bulbs frequently burn out after only 500 to 1,000 hours.

In an attempt to develop panel illumination devices with a greater life span, light-emitting diodes ("LED's") have been tried as substitutes for incandescent light bulbs. See, for example, U.S. Pat. No. 4,965,457.

LED's have a life span typically greater than about 500,000 hours. However, a single LED generally emits much less light than a typical light bulb, so a number of LED's must be grouped together in a single assembly (array) to provide the requisite illuminating power.

Also, unlike the light given off by a light bulb, the light emitted from an LED is projected in only one direction. Therefore, an LED array must be properly directed towards the object which is to be illuminated. Unfortunately, where the array is installed with the screw-in or bayonet-style mount commonly used in commercial applications, it has been impossible to change the orientation and direction of the light projected by an LED array after the illuminating array is installed.

There is therefore a need for a panel illumination array which may be adjusted after the device has been installed so as to direct light emitted onto the object to be illuminated.

SUMMARY OF THE INVENTION

The invention satisfies this need.

The invention comprises a plurality of light-emitting electrical units that are affixed in a defined spacial relationship relative to one another. The light-emitting units are electrically interconnected to form an array having a pair of opposite electrical poles.

In a preferred embodiment, the light-emitting electrical units are light-emitting diodes. The array is mounted on an electrically conductive cylindrical base connector having charged electrical poles. The base connector is adapted to fit into a typical female electrical connector socket. The opposite electrical poles of the array are electrically connected to the electrical poles of the cylindrical base connector so as to form an electrical circuit.

Means are further provided to allow the array to be rotated relative to the base connector and to restrict such rotation when desired. In one embodiment, the means for rotatably affixing the array to the conductive base connector comprises a shaft having a head and a body. The portion of the shaft body distal to the shaft head is affixed within the cylindrical base connector along the longitudinal axis of the base connector. The shaft head is rotatably affixed to the supporting structure to which the array is affixed.

In the embodiment discussed in the immediately preceding paragraph, the means for restricting the rotation of the array is provided by the interaction of a conductive pin and a plurality of notches defined in the periphery of the cylindrical base connector. The conductive pin is affixed within the structural support and extends beyond the other portions of the structural support in the direction of the cylindrical base connector. Proximate to where the cylindrical base connector adjoins the structural support, the cylindrical base connector has a conductive ring about its periphery. The conductive ring is notched with a plurality of notches adapted to receive the conductive pin.

The invention provides the ability to illuminate an object, such as a panel board parameter display, with an array of durable, low-maintenance LED units. The prior art problem stemming from the unidirectional nature of LED illumination is overcome in the invention by the provision of means for rotating the LED array after its installation (so that its illumination can be aimed directly at the object) and means for thereafter restricting the rotation of the array (to maintain the array in proper orientation).

DRAWINGS

These and other features, aspects and advantages of the present invention will become understood with reference to the following description, appended claims and accompanying drawings where:

DESCRIPTION

Figure 10A:
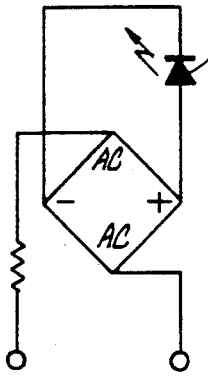
FIGS. 6–12 are additional schematic drawings showing electrical circuitry that may be used for the rotatable LED cluster device shown in FIG. 1.
Figure 1:
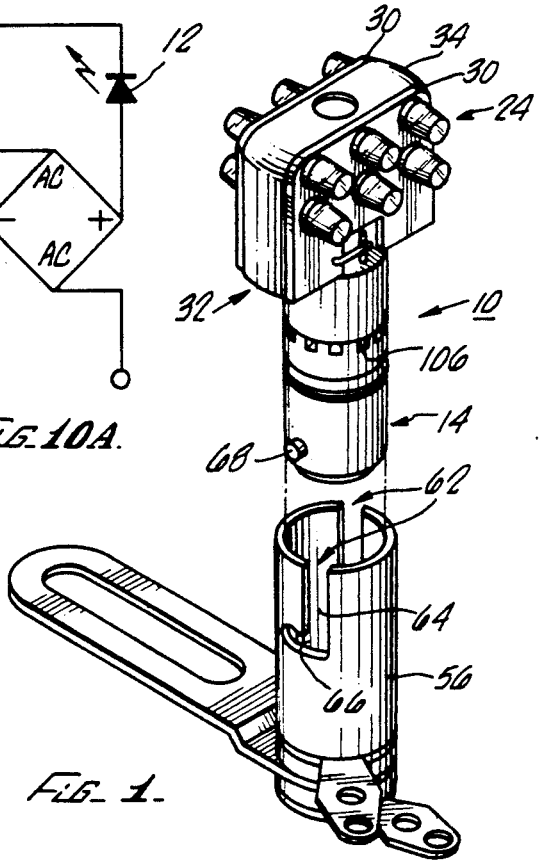
FIG. 1 is a perspective view of a rotatable LED cluster device embodying features of the invention.

The following discussion describes in detail one embodiment of the invention and several variations on that embodiment. This discussion should not be construed, however, as limiting the invention to those particular embodiments. Practitioners skilled in the art will recognize numerous other embodiments as well. For a definition of the complete scope of the invention, the reader is directed to the appended claims.

Referring to the drawings, a panel illuminating module 10 embodying features of the invention is shown in several views. The module 10 comprises (1) a plurality of light-emitting electrical units 12, (2) an electrically conductive cylindrical base connector 14, (3) means for rotatably affixing the plurality of light-emitting electrical units 12 relative to the cylindrical base connector 14, and (4) means for restricting such rotation when desired.

The light-emitting electrical units 12 are preferably LED units. LED's are preferred as light-emitting units over ordinary light bulbs since LED's have a much longer service life. However, any of the standard miniature light bulbs or other light-emitting electrical units available in the art are also usable in the invention.

Any number of light-emitting electrical units 12 can be used depending on illumination requirements and space restrictions.

The light-emitting electrical units 12 are electrically connected to one another to form a single array 16 having a first electrical pole 18 and a second electrical pole 20. The light-emitting electrical units 12 shown in the drawings are electrically interconnected by solder trails 22. It is preferred that the circuitry consist of solder trails imposed on a printed circuit board surface in order to facilitate efficient manufacture of the device. However, other means for electrically interconnecting the light-emitting electrical units 12, such as electrical wires, may also be used.

Figure 5:
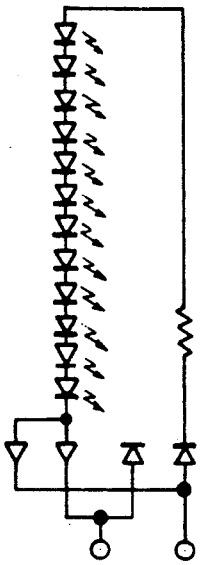
FIG. 5 is a schematic drawing showing the electrical circuitry for the rotatable LED cluster device shown in FIG. 1.
Figure 2:
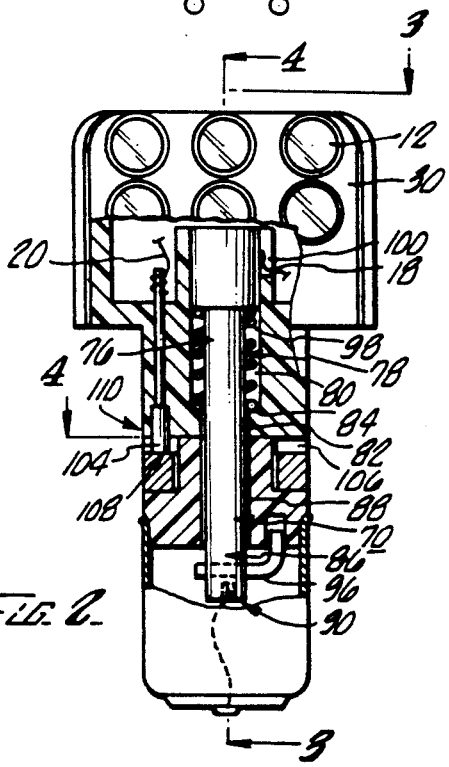
FIG. 2 is a first side view with partial cutaway of the rotatable LED cluster device shown in FIG. 1.
Figure 4:
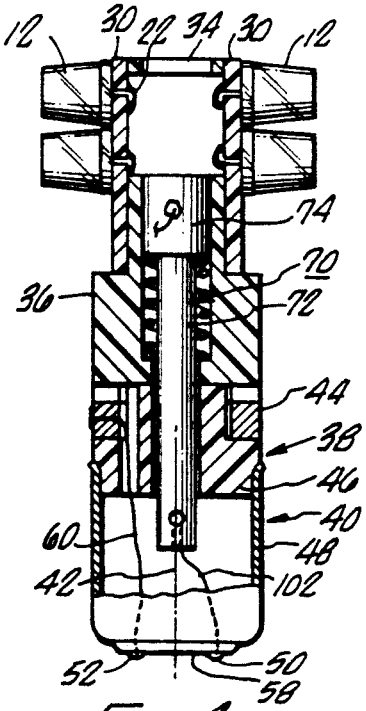
FIG. 4 is a second side view with partial cutaway of the rotatable LED cluster device shown in FIG. 1.
Figure 3:
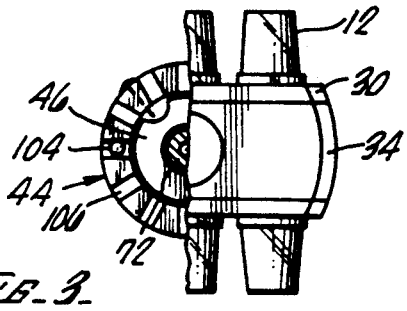
FIG. 3 is a top view of the rotatable LED cluster device shown in FIG. 1 with a partial cutaway showing detail at arrows.
Figure 6:
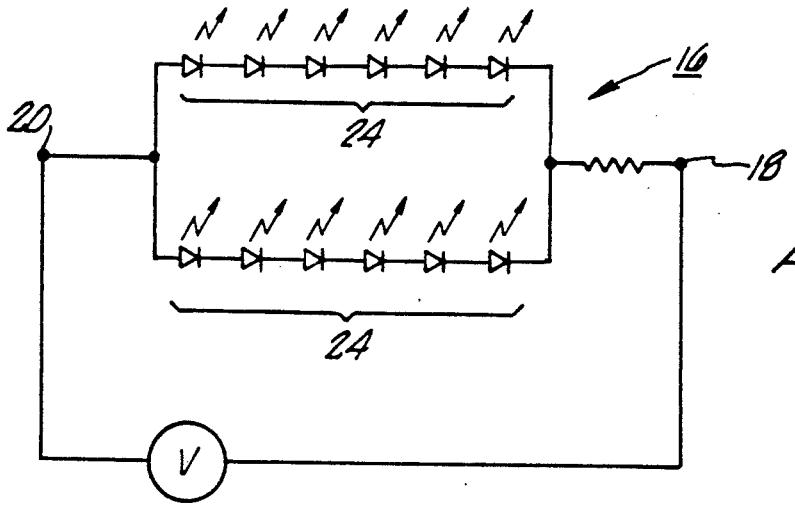
Figure 7:
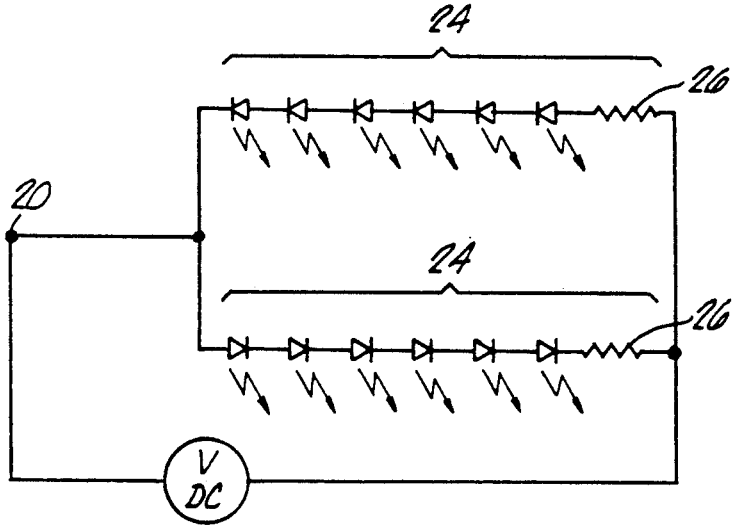
Figure 8:
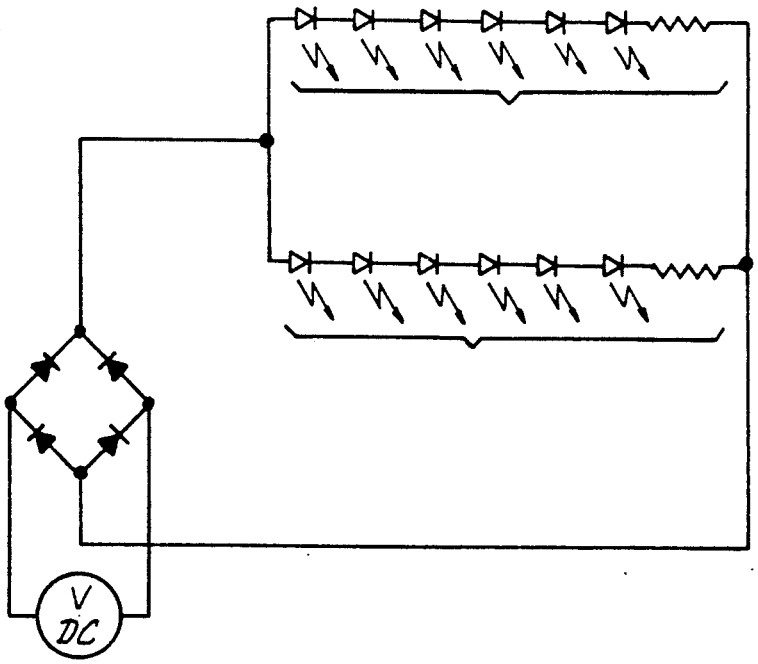
Figure 9:
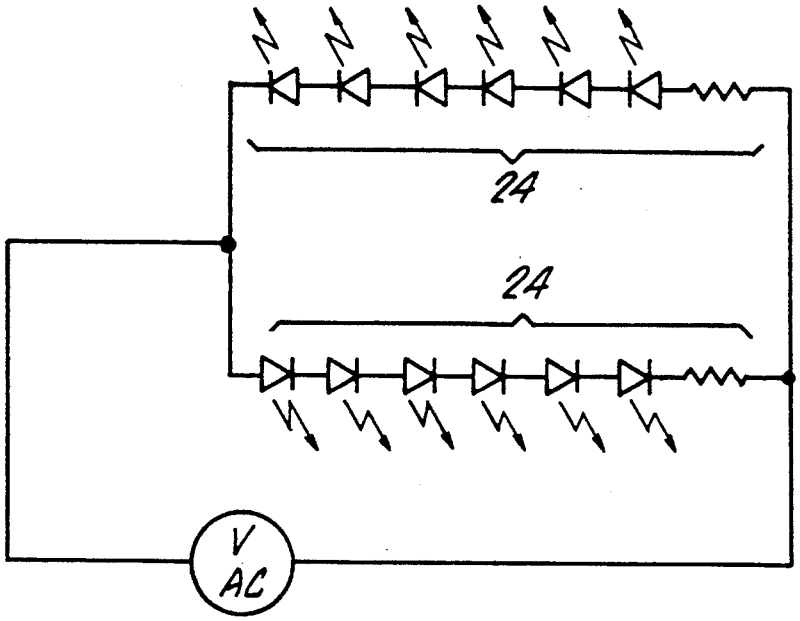
Figure 10B:
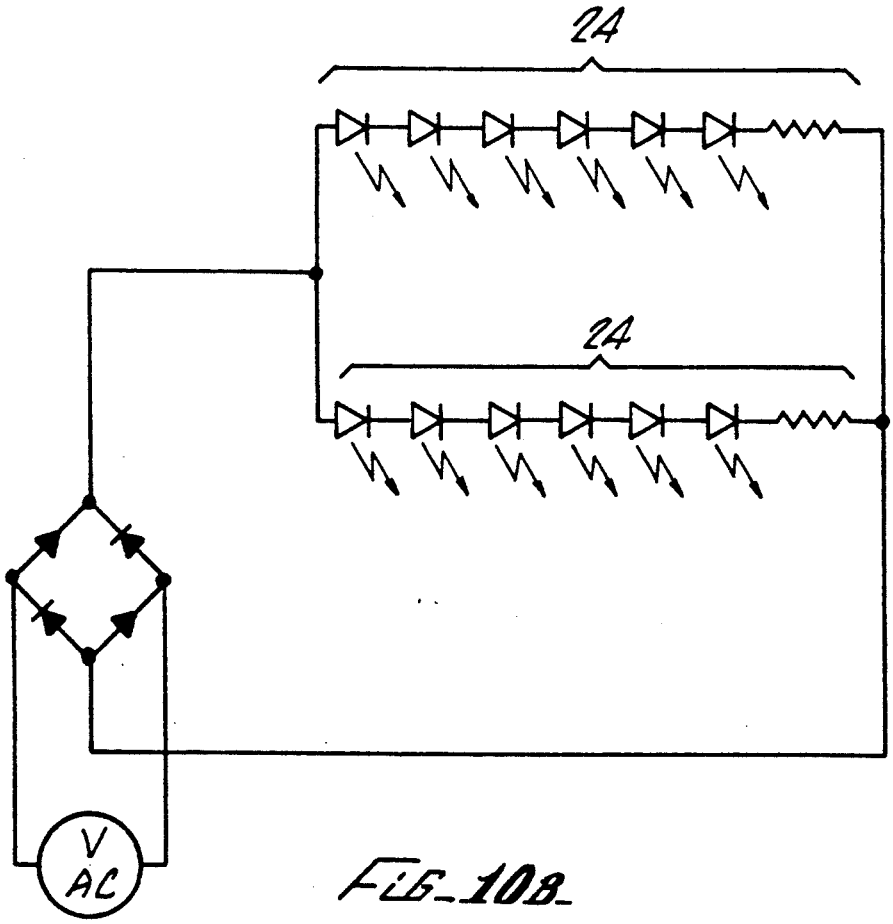

The electrical circuitry for the embodiment illustrated in FIGS. 1–4 is shown in diagrammatic form in FIG. 5 for a direct current power supply. Twelve LED units 12 are electrically arranged in a single bank 24, in series with a resistor 26. Those skilled in the art will recognize that any number of other circuitry schemes can also be used. Several such alterative schemes are illustrated in FIGS. 6–12.

The light-emitting electrical units 12 are affixed in a defined spacial relationship to one another. In the embodiment illustrated in the drawings, the LED units 12 are affixed to planar baseboards 30. For simplicity and for maximum efficiency in the manufacturing process, the baseboard 30 is made from a standard printed circuitry baseboard ("PC Board"). This PC Board may comprise a fiberglass or ceramic planar substrate coated on its upper and lower surfaces with an electrically conducting material such as copper. However, such baseboards 30 may comprise any electrically insulating material such as wood, plastic, fiberglass, ceramic materials, etc.

In the embodiment illustrated in the drawings, two parallel planar baseboards 30 are used, each bearing one of the two LED banks 24. The two LED banks 24 are aimed in opposite directions to provide illumination to two different objects or surfaces.

The baseboards 30 are affixed to and separated by a support structure 32. The support structure 32 consists of a frame member 34 and a lower cylindrical member 36 which are affixed to one another. The two baseboards 30 are affixed to opposite sides of the frame member 34. The support structure 32 can be made out of plastic. Other materials, such as metals, glass and wood, can also be used.

The cylindrical base connector 14 has a first base connector section 38 and a second base connector section 40. The base connector 14 is relatively elongated and has a longitudinal axis 42. The first base connector section 38 is disposed proximate to the support structure 32 and the second base connector section 40 is disposed distal to the support structure 32.

In the embodiment illustrated in the drawings, the first base connector section 38 comprises an electrically conductive ring 44 affixed to an electrically non-conductive cylindrical member 46. The second base connector section 40 comprises a cylindrical mounting section 48, a first electrical pole 50 and a second electrical pole 52. Additional electrical poles (not shown) can also be provided to create devices having electrically-separate arrays such as illustrated in FIG. 12.

The two electrical poles 50 and 52 are disposed at the terminus 54 of the second base connector section 40 so as to match up with, and contact, the two electrical contacts in a standard female connector socket 56. The two poles 50 and 52 are electrically insulated from one another and from the cylindrical mounting section 48 by an insulator member 58. The cylindrical mounting section 48 is insulated from the conductive ring 44 in the first base connector section 38 by the electrically non-conductive cylindrical member 46. The second pole 52 is electrically connected to the electrically conductive ring 44 by a first lead wire 60.

Figure 11:
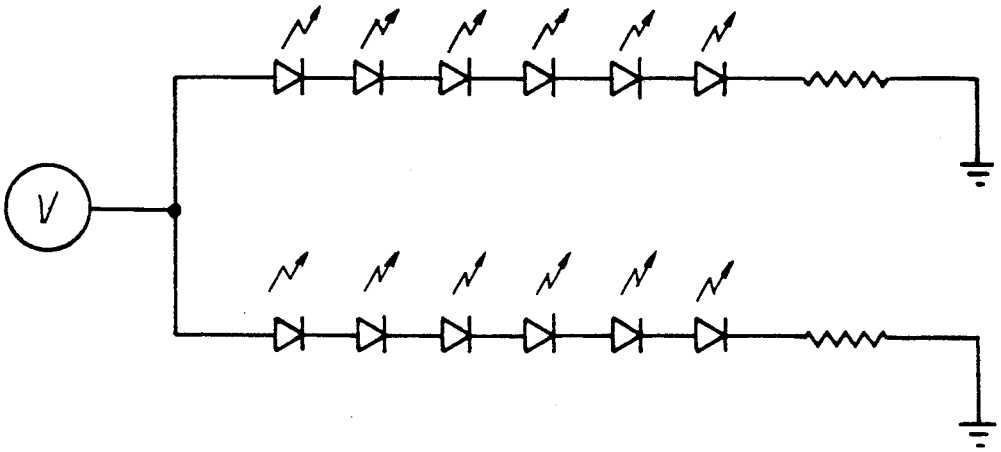
Figure 12:
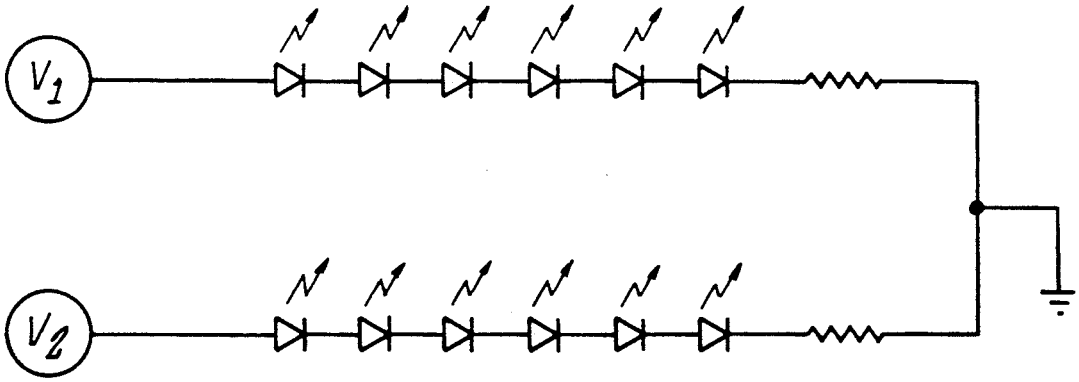

In embodiments of the invention illustrated in FIGS. 11 and 12, parallel arrays are energized by two separate electrical circuits. In these embodiments, two separate conductive rings 44, each connected to a first lead wire 60 could be used. These embodiments would allow for variations in the light provided by the parallel arrays, such as variations in intensity and color.

The non-conductive cylindrical member 46 can be made from glass. A preferred material is plastic because it can be easily molded or machined to achieve the desired structural and support characteristics. The electrically conductive ring 44 can be made from any conductive material such as a metal. Brass can be used, as can aluminum or copper.

The second base connector section 40 is externally dimensioned to connect to the corresponding female connector socket 56. Where the corresponding female connector socket 56 is a bayonet-style connector socket having two or more bayonet connection L-shaped grooves 62 (having a longitudinal groove moiety 64 and an axial groove moiety 66) as shown in the embodiment illustrated in the drawings (such as connector sockets 56 known in the industry as T 3¼ dual contact bayonet sockets), the second base connector section 40 is provided with an equivalent number of bayonet connection projections 68 adapted to cooperate with, and interlock within, the bayonet connection grooves 62. In other embodiments, where the corresponding female connector socket 56 is of a screw-in style, the second base connector section 40 is adapted with corresponding threads.

In the embodiment illustrated in the drawings, the means for rotatably affixing the plurality of light emitting units 12 relative to the cylindrical base connector 14 is provided by a shaft 70. The shaft 70 has a cylindrical body 72 and a cylindrical head 74. The diameter of the shaft head 74 is slightly larger than that of the body 72. The shaft 70 is slidably disposed along the longitudinal axis 42 of the base connector 14. A first portion of the shaft 76, including the shaft head 74 and part of the shaft body 72, is housed in a cylindrical central chamber 78 defined by the lower cylindrical member 36 of the support structure 32. Such central chamber 78 has a first section 80 with a diameter which is only slightly larger than the diameter of the shaft head 74 and a second section 82 with a second diameter which is only slightly larger than the diameter of the shaft body 72. The intersection of these first and second chamber sections 80 and 82 defines a small lip 84.

A second portion of the shaft 86, comprising the remainder of the shaft body 72, is affixed in a corresponding central chamber 88 defined by the nonconductive cylindrical member 46 of the cylindrical base connector 14. In the embodiment illustrated in the drawings, the means for affixing the second portion of the shaft 86 in the chamber 88 is provided by an axial pin 96 affixed in the shaft body terminus 90 at right angles to the longitudinal axis 42 of the cylindrical base connector 14.

The shaft 70 is housed within the chamber 78 defined in the support structure 32 such that the shaft 70 can be displaced along the longitudinal axis 42 within the support structure 32 and such that the support structure can be rotated relative to the base connector 14.

The support structure 32 is held in contact with the base connector 14 by tension provided by a compression spring 98 disposed around the shaft body 72 and within the first section 80 of chamber 78 which is defined by the support structure 32. The spring 98 has an internal diameter larger than the diameter of the shaft body 72 but smaller than both the diameters of the shaft head 74 and the second section 82 of the chamber 78 defined in the support structure 32. Thus, the spring 98 impinges at its one end against the shaft head 74 and, at its opposite end, against the lip 84 defined by at the intersection of the first and second sections of the chamber 78 defined in the support structure 32.

The shaft 70 is composed of an electrically conductive material such as a metal. Brass, aluminum or copper can be used. A preferred material for the shaft is brass because of its corrosion resistance and ease of machining. The first portion 76 of the shaft 70 is electrically connected to the first electrical pole 18 of the array of light-emitting electrical units 12 by a second wire lead 100. The second portion 86 of the shaft 70 is electrically connected to the first pole 50 in the base connector 14 by a third wire lead 102. Instead of the wire lead connectors, spring loaded metal connectors may be used.

In the embodiment shown in the drawings, the means for restricting the rotation of the plurality of light-emitting electrical units 12 relative to the base connector 14 is provided by an electrically conductive locking pin 104 and a plurality of notches 106 defined within the electrically conductive ring 44. The locking pin 104 is affixed in the periphery of the non-conductive cylindrical member 46 and is disposed in parallel with the longitudinal axis 42. The terminus 108 of the locking pin 104 extends beyond the terminus 110 of the non-conductive cylindrical member 46 by a small distance. The locking pin 104 is received in one of the plurality of notches 106 defined within the conductive ring 44. Each notch 106 is dimensioned so that, when the support structure 32 is proximate to the base connector 14, the locking pin 104 is in electrical contact with the conductive ring 44. The "heights" of the notches 106 in the direction parallel to the longitudinal axis 42 of the base connector 14 are uniform.

It should be noted that the locking pin 104 and the notches 106 can have rounded edges to facilitate the disengagement of the pin 104 from the notches 106.

The locking pin 104 is electrically connected to the second electrical pole 20 of the array 16 by a fourth wire lead 112. Thus an electrical circuit is formed between the array 16 and the female connector socket 56 as follows: first electrical pole of connector socket 50> third wire lead 102> shaft 70> second wire lead 100> first electrical pole 18 of array 16> array 16> second electrical pole 20 of array 16> fourth wire lead 112> locking pin 104 > conductive ring 44> first electrical wire lead 60> second pole 52 of connector socket 56.

In operation, the panel illuminating module 10 illustrated in the drawings is inserted into a female connector socket 56 by sliding the bayonet connection projections 68 of the base connector 14 into the longitudinal moieties 64 of the bayonet connection grooves 62 defined in the connector socket 56. The module 10 is then locked into the connector socket 56 by rotating the module 10 so as to slide the bayonet connection projections 68 into the axial moieties 66 of the bayonet connection grooves 62. During this step, the module support structure 32 is prevented from rotating relative to the module base connector 14 by the locking pin 104 which is received within a first notch 106 in the conductive ring 44.

The array 16 is then directed to the object to be illuminated by rotating the support structure 32 while allowing the base connector 14 to remain stationary within the connector socket 56. This is accomplished by: (1) gripping the support structure 32 and pulling it in a direction away from the base connector 14 (against the tension provided by the spring 98) until the locking pin 104 is retracted out of the first notch 106 in the conductive ring 44 (the inability of the axial pin 96 to be received into the chamber 88 defined within the non-conductive cylindrical member 46—because of its greater cross-section-preventing the support structure 32 from becoming separated from the base connector 14); (2) rotating the support structure 32 until the array 16 is properly aimed at the object or surface to be illuminated; and (3) allowing the spring tension to pull the support structure 32 back into contact with the base connector 14 (with the locking pin 104 now received within a second notch 106 in the conductive ring 44).

An additional advantage inherent in the invention is that, in those invention embodiments having parallel banks of light emitting electrical units, the failure of any light-emitting unit in any one of the banks will not cause the panel-illuminating module to totally fail. Only the bank of light-emitting electrical units wherein the failed unit is disposed will fail. Such redundancy is not possible when using the single light bulbs of the prior art.

Also, as noted above, a further advantage of the invention is that it can be used to energize parallel arrays of differently colored light-emitting units. For example, a first color can be energized using a first electrical pole and a second color can be energized using a second electrical pole. A third color can be produced by using both poles simultaneously.

EXAMPLE

In an illustrative example embodiment of a rotatable LED cluster device of the invention, the baseboards are standard PC Board made of copper-coated fiberglass. Circuitry paths are made on the board with copper traces coated with tin/lead solder. The baseboard is rectangular, having a length of 1.5 inches and a width of 2.0 inches.

The base connector is a T 3¼, double contact bayonet base. The shaft is made of brass. Its overall length is 2.25 inches. The head portion of the shaft is 0.125 inches in length. The shaft has a nominal diameter of 0.125 inches. The head portion of the shaft has a diameter of 0.175 inches.

The spring is constructed of phosphor bronze. It is 0.3 inches long. It has an outside diameter of 0.160 inches. The spring has five coils and a closed end. It is constructed of wire having a diameter of 0.030 inches.

Twelve LED units are used. Each of the LED units is a standard 125-FPCX, 0.200 diameter, T 1¾ midget light emitting diode. A single resistor is used in series with the LED array. The resistor is rated at 400 ohms, ½ watts. When installed in a panel powered by direct current having a voltage of 36 the unit uses 30 milliamps of current and produces 300×12 millicandeles of light.

Although the present invention has been described in considerable detail with reference to certain preferred versions, many other versions should be apparent to those skilled in the art. Therefore, the spirit and scope of the appended claims should not necessarily be limited to the description of the preferred versions contained therein.

What is claimed is:

1. A panel illuminating display module comprising:

(a) structural support means for affixing a plurality of light-emitting electrical units relative to one another, the light-emitting electrical units being electrically interconnected to form an array having a first electrical pole and a second electrical pole;

(b) a cylindrical base connector having a longitudinal axis, a first electrical pole and a second electrical pole, the base connector being adapted for reception within, and electrical connection to, a female connector socket having a pair of oppositely charged electrical poles, the cylindrical base connector further comprising a first cylindrical chamber having a diameter slightly larger than the diameter of the shaft;

(c) means for electrically connecting the first and second electrical poles of the array to the first and second electrical poles of the electrically conductive cylindrical base connector, respectively;

(d) means for rotatably affixing the array to the conductive base connector, comprising a shaft having a cylindrical body and a cylindrical head disposed on one end of the body, the diameter of the shaft head being greater than the diameter of the shaft body, the portion of the shaft body distal to the shaft head being affixed within the first cylindrical chamber along the longitudinal axis of the cylindrical base connector and the shaft head being rotatably affixed to the structural support means; and (e) means for restricting the rotation of the array relative to the cylindrical base connector;

Wherein:

the shaft head is cylindrical and has a diameter greater than the diameter of the shaft body;

the shaft and the portion of the shaft body proximate to the shaft head are disposed within a second cylindrical chamber which is defined within the support structure;

the portion of the shaft body disposed within the structural support but not within the second chamber is disposed within a third chamber which is defined within the structural support, the third chamber having a diameter which is smaller than the diameter of the second chamber;

the second and the third chambers intersect and, at the point of intersection, form a lip; and a compression spring having an external diameter larger than the diameter of the third chamber is disposed around the shaft body within the second chamber, the spring impinging at its one end against the shaft head and at its other end against the lip formed by the intersection of the second and third chambers.

2. The panel illuminating display module according to claim 1 wherein:

(a) the cylindrical base connector further comprises a conductive ring disposed about the periphery of the cylindrical base connector proximate to the support structure;

(b) a plurality of notches are defined in the conductive ring; and (c) the structural support further comprises a conductive pin adapted to be received into one of the notches.

3. The panel illuminating display module according to claim 2 wherein:

(a) the first electrical pole of the cylindrical base connector is electrically connected to the shaft;

(b) the shaft is electrically connected to the first pole of the array;

(c) the second pole of the array is electrically connected to the conductive pin; and (d) the conductive ring is electrically connected to the second pole of the cylindrical base connector.

4. The panel illuminating display module according to claim 2 wherein the number of notches is at least two.

5. The panel illuminating display module according to claim 2 wherein the number of notches is at least four.

* * * * *